United States Patent [19]

Rucker et al.

[11] 4,174,259

[45] Nov. 13, 1979

[54] ELECTROLYTIC CELL STRUCTURE AND METHOD OF ASSEMBLY

[75] Inventors: John T. Rucker, Lewiston; Donald H. Porter, Kenmore, both of N.Y.

[73] Assignee: Hooker Chemicals & Plastics Corp., Niagara Falls, N.Y.

[21] Appl. No.: 726,312

[22] Filed: Sep. 24, 1976

[51] Int. Cl.[2] ..... C25B 13/02; C25B 13/08; C25B 9/00; C25B 11/03

[52] U.S. Cl. ..... 204/252; 204/279; 204/296; 204/283

[58] Field of Search ..... 204/252, 279, 296, 283

[56] References Cited

U.S. PATENT DOCUMENTS

| | | | |
|---|---|---|---|
| 3,945,910 | 3/1976 | Ceuster et al. | 204/296 |
| 3,975,255 | 8/1976 | Kircher | 204/279 X |
| 3,980,613 | 9/1976 | Bachot et al. | 204/296 X |
| 4,014,775 | 3/1977 | Kircher et al. | 204/279 X |

*Primary Examiner*—John H. Mack
*Assistant Examiner*—D. R. Valentine
*Attorney, Agent, or Firm*—Peter F. Casella; Howard M. Ellis; William G. Gosz

[57] ABSTRACT

An improved electrolytic cell comprises the combination of a wide electrode, or more closely spaced electrodes, to achieve a narrow gap between electrodes, the electrodes being of conventional, simple, non-adjustable construction, guide spacers separating the anode elements and cathode elements of the electrolytic cell, and a hard, dimensionally stable, diaphragm.

11 Claims, 3 Drawing Figures

ELECTROLYTIC CELL STRUCTURE AND METHOD OF ASSEMBLY

BACKGROUND OF THE INVENTION

A commercially significant application of electrolysis is the production of halogens, particularly chlorine, and alkali metal hydroxides, particularly sodium hydroxide, by electrolysis of aqueous alkali metal halide solutions, particularly sodium chloride solutions, in electrolytic cells with diaphragms between the anode and cathode elements of such cells. Most cell designs contain three basic elements, namely, the anode, cathode and diaphragm. The vehicle for both supporting the anodes within the cell compartment and conducting the electrolyzing current to the anode posts is the anode base. In some instances, the anodes may be supported from the top or sides of the cell rather than be extended from the bottom, and in such cases, the top or side becomes the "base " for the purposes described herein. Commonly, the anodes are arranged vertically in uniformly spaced rows covering the width of the anode base. The cathode generally rests upon the anode base but is electrically insulated therefrom, and the cathode elements serve to divide the cell into a series of anolyte and catholyte compartments. The cathode elements additionally serve to support the diaphragm, which can be a layer of asbestos fibers or asbestos fibers and additional materials, such diaphragm serving to separate the anolyte and catholyte compartments of the cell. In the conventional diaphragm cell a relatively wide gap is maintained between the anode and the cathode, with the diaphragm separating the two. Modern cells employ a dimensionally stable foraminous metal anode, and the cathode is usually foraminous iron or steel. Each commercial cell contains a plurality of anode and cathode elements. The anode elements are fixed to the anode base and are spaced apart in a manner which permits cathode elements to be alternated between anode elements.

In the normal construction of such cells, the diaphragm is in direct contact with the cathode elements. Frequently, the diaphragm is deposited on the cathode by immersing the cathode in an aqueous slurry of asbestos, which may contain additional materials, and causing the slurry to flow through pores or mesh openings of the foraminous cathode until a porous sheet or layer of asbestos has been deposited on the sides of the cathode which in use are opposite the anode.

When the diaphragm cell is used to produce chlorine, an akali metal chloride solution is used as the cell electrolyte. As current passes through the electrolyte between the anode and cathode, chlorine is evolved at the anode and alkali metal hydroxide is formed with liberation of hydrogen at the cathode. The porous diaphragm described above, located in the anode-cathode gap, prevents mixing of the hydrogen with chlorine and mixing of formed caustic with incoming brine and chlorine.

In diaphragm cells, it is desired to keep the gap between anode and cathode small to minimize the resistance of the electrolyte in the gap to passage of electrolyzing current, and thereby reduce significantly the operating voltage of the cells and reduce energy consumption and increase power efficiency.

With conventional diaphragm cells, the gap between anode and cathode cannot be reduced below a certain practical minimum distance. Normally, a relatively wide separation between electrode elements must be specified in cell construction to allow for dimensional deviations or misalignments of the anodes and diaphragm-covered cathodes. Otherwise, such deviations or misalignments would cause scraping and injury to the diaphragm between the anode and cathode during assembly of the cell. Such scraping must be avoided to prevent breaking the diaphragm, which would cause operating problems due to mixing of the anodic and cathodic electrolysis products or electrical short-circuiting between anodes and cathodes. Cathodes, which are generally steel screens, and anodes, which are generally coated titanium mesh, become misshapen and distorted through use and with age. Furthermore, the diaphragm material is normally deposited by vacuum upon the surface of the cathode from a slurry, and the result is often a diaphragm of non-uniform thickness. Normal anode and cathode heights are more than twelve inches, and often as much as thirty or more inches, making net displacements from the vertical approaching 0.5 inch at one or more mating sites a common result as a practical matter. Therefore, when an attempt is made to place the cathode fingers, carrying the diaphragm thereon over vertically-disposed anode blades, difficulties will be encountered unless such cell are specified at a designed anode-cahode gap of approximately 0.5 inch. Difficulties include destruction of diaphragms, and the like, as pointed out in U.S. Pat. No. 3,674,676 to Fogelman.

A consideration which limits the narrowness of the inter-electrode gap relates to the passage of chlorine evolved at the anode and the replenishing of brine solution in contact with the anode. If the inter-electrode gap is too narrow in operation of the cell, cell performance can be affected adversely because of insufficient brine circulation, the formation of gas pockets, or development of hot spots. These problems are observed in operation of cells with inter-electrode gaps less than about 5 millimeters.

SUMMARY OF THE INVENTION

The present invention relates to the use of conventionally constructed non-adjustable box-type anodes in electrolytic cells with a reduced gap, in a manner contrary to prior teachings. To achieve this result, a combination of three elements is employed, namely, a wide electrode or alternatively, more closely spaced electrodes, or both, a guide spacer, and a hard, dimensionally stable polymer-bonded diaphragm.

A widened anode or cathode gives a narrowed gap between electrodes where an existing anode base along with other cell elements is retained. Preferably, dimensionally stable metal anodes are utilized, comprising generally an electrically conductive, electrocatalyticallly active coating, such as platinum or a noble metal oxide, on an electrically conductive substrate, which can be a valve metal, such as titanium. Either the dimensionally stable anode elements or the cathode elements can be made wider and installed in an existing cell. Alternatively, a new cell with altered anode base design can be constructed with a smaller lateral dimension to accomplish a desired gap reduction by reducing the center-to-center electrode spacing. For an existing industrial installation the use of wider anodes is the preferred mode of reducing the inter-electrode gap.

A guide spacer shaped approximately like a hairpin extends over an anode element vertically downward from the anode top. The guide spacers comprise two parallel members joined at the upper end in a sloping configuration, which can be rounded, so as to form an inverted U, or pointed, to form a ridge. Other configurations of guide spacer shapes are possible, subject to the requirement that the shape permit the guide spacer to function as a guide for assembly of the cell. The guide spacer can extend downward a portion of or the entire distance to the bottom of the anode. The sloping upper portions of the guide spacers serve the purpose of guiding the cathode elements into their proper position between anode elements as the cathode carrying the diaphragm is lowered over the anode elements during cell assembly. Preferably two or four guide spacers are positioned on each anode element. Loosely held guide spacers can later be removed before final installation of the cell top, leaving only the tightly held guide spacers in the cell.

Guide spacer materials of construction include substances which are hard, non-conductive and resistant chemically and physically to the cell environment. For example, chlorinated polyvinyl chloride has been used successfully for this purpose. Fluorine-containing polymers also are suitable for fabrication of guide spacers.

Prior art spacers for use in electrodialysis cells are shown in U.S. Pat. No. 3,271,292 to Kollsman, U.S. Pat. No. 3,284,335 to Tsunoda et al and U.S. Pat. No. 3,761,386 to Smith. These are of grid-like net structure, rather than the hairpin-like construction of the present invention. U.S. Pat. No. 3,975,255 shows a spacer fixedly attached to diaphragm cell anode. Cord spacers for use in a chlorate cell are taught in U.S. Pat. No. 3,732,153 to Harke et al, but such spacers do not function as guides to facilitate cell assembly.

A hard, dimensionally stable, diaphragm comprises the third element of the combination of the present invention. This diaphragm must provide sufficient bearing pressure to prevent substantial penetration of any guide spacer into the diaphragm during cell assembly. Unless such penetration can be avoided, destructive scraping of the diaphragm by the anode can result. An example of a suitable diaphragm is fluoropolymer bonded asbestos, known under the proprietary tradename HAPP, a trademark of Hooker Chemicals & Plastics Corp.

The advantages of such a combination for use in an electrolytic cell are manifold.

DESCRIPTION OF THE DRAWINGS

The present invention will be more fully described by reference to the drawings in which:

Referring now to FIG. 1, the cathode structure (11) has been covered with the hard diaphragm (12) and has been placed in a position for insertion into the cell. The anode structure (10) has been positioned into its location into the cell, and over the top edge of the anode structure (10) has been placed a guide spacer (14). The legs of the guide spacer may extend the entire surface of the anode, or may extend downward only a short distance of the anode. The top sloping portion of the guide spacer is to serve as a lead or a guide for assisting in the positioning of the cathode structure (11 and 12) into the opening between the adjacent guide spacers (14). With the insertion of the cathode diaphragm structure into its proper position between the previously positioned anode structure, the upper surface of the guide spacer being curved or rounded, will assist in the entry of the diaphragm-coated cathode into the opening between the anodes without damage to the diaphragm. The hard dimensionally stable diaphragm as described in this invention will allow the pressure of the guide spacer to align the cathode assembly for its entrance into the cell without damage to the diaphragm.

FIG. 2 illustrates the positioning of the elements during the insertion operation of the cathode into its proper position between adjacent anodes. As shown in FIG. 2, the foraminous steel cathode structure (11) has been covered by a hard diaphragm (12). This diaphragm (12) upon insertion will be guided away from the surface of the anode (10) by the guide spacer element (14), and the guide spacer element (14) will assist in the establishment of the gap between the surface of anode (10) and the surface of diaphragm (12). Since the guide spacer is of a dimension slightly smaller than the desired gap, the spacer will establish a minimum size for the gap, but not necessarily the actual size for the gap, and upon complete positioning of the cathode structure in the cell, the guide spacer (14) which is not in contact with the diaphragm surface (12) may be removed from its position on the top of the anode and not retained in the cell during cell operation.

FIG. 3, which is a horizontal cross sectional segment of the cell after installation of all electrodes, shows that the relative location of the guide spacer element (14) and can be placed where the assembler deems to position it on top of the anode structure.

Figure 1:
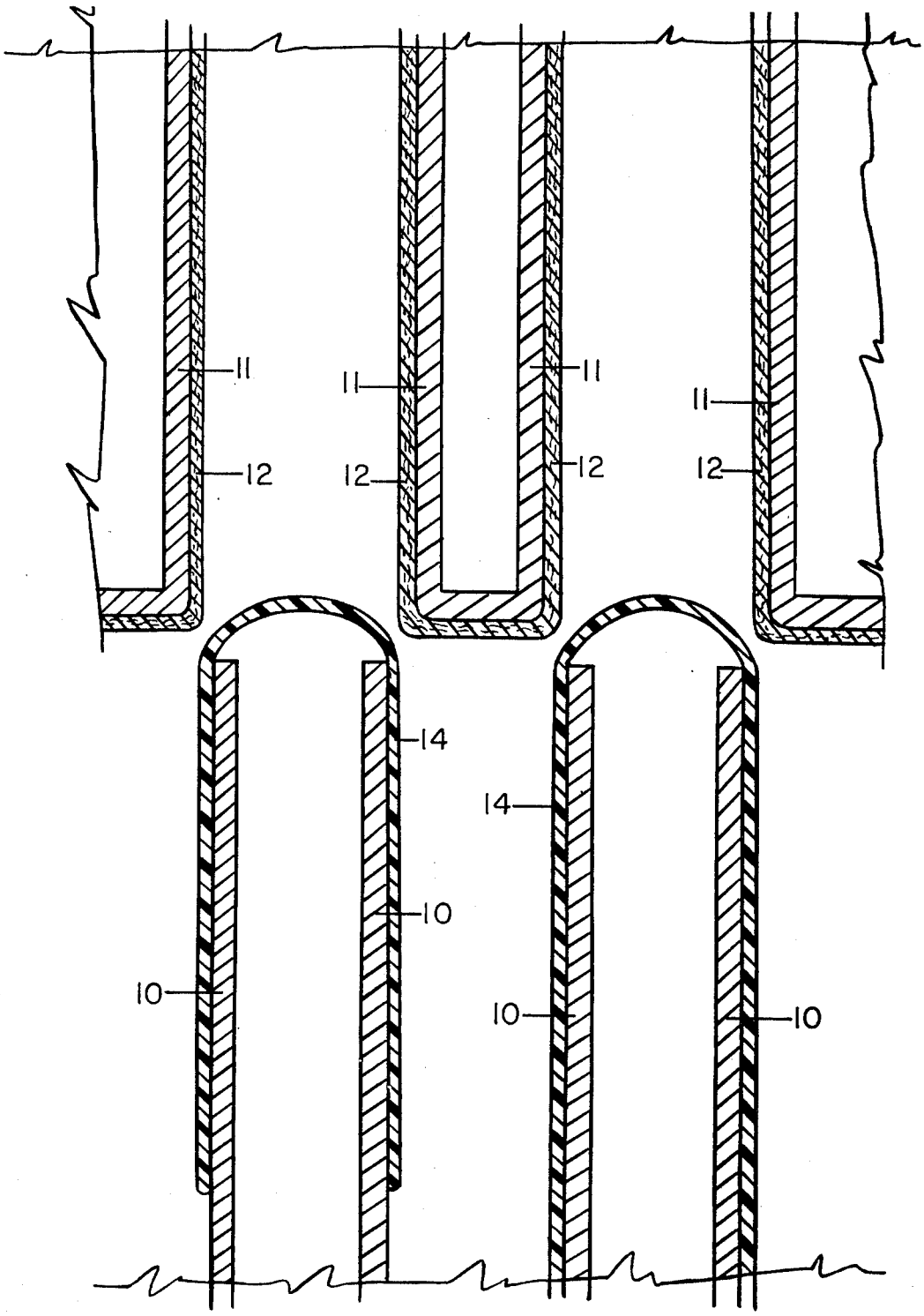
FIG. 1 is a side cross sectional view of cathodes and anodes prior to insertion.
Figure 2:
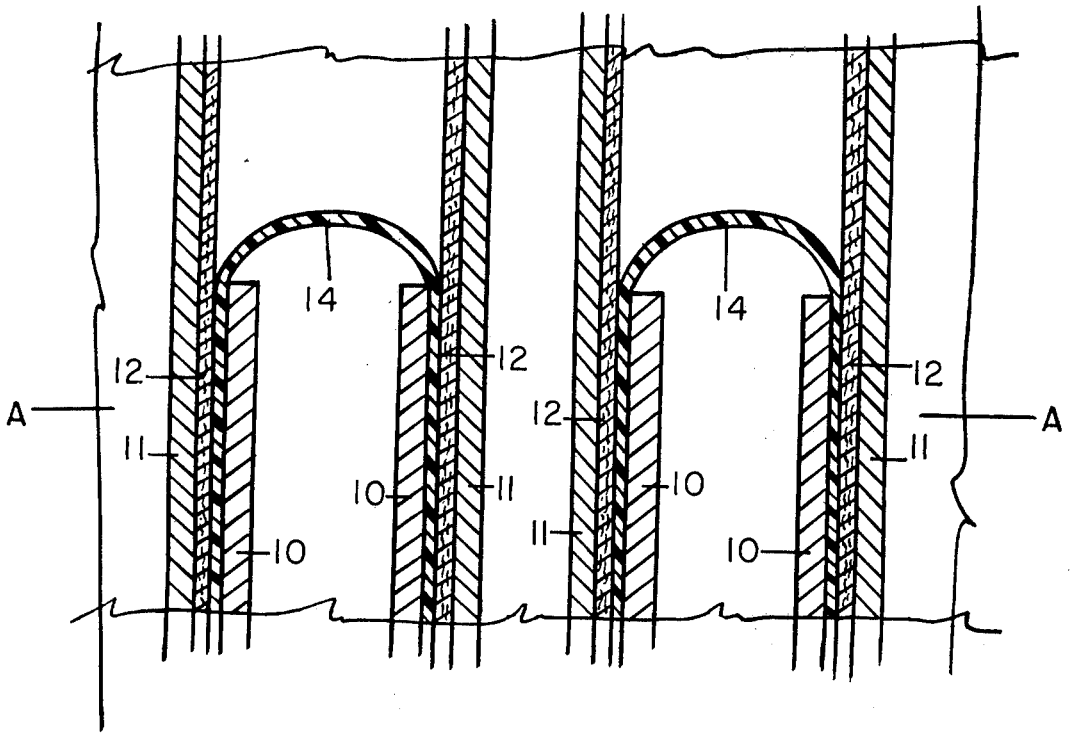
FIG. 2 is a side cross sectional view during insertion of cathodes into the anode structure.
Figure 3:
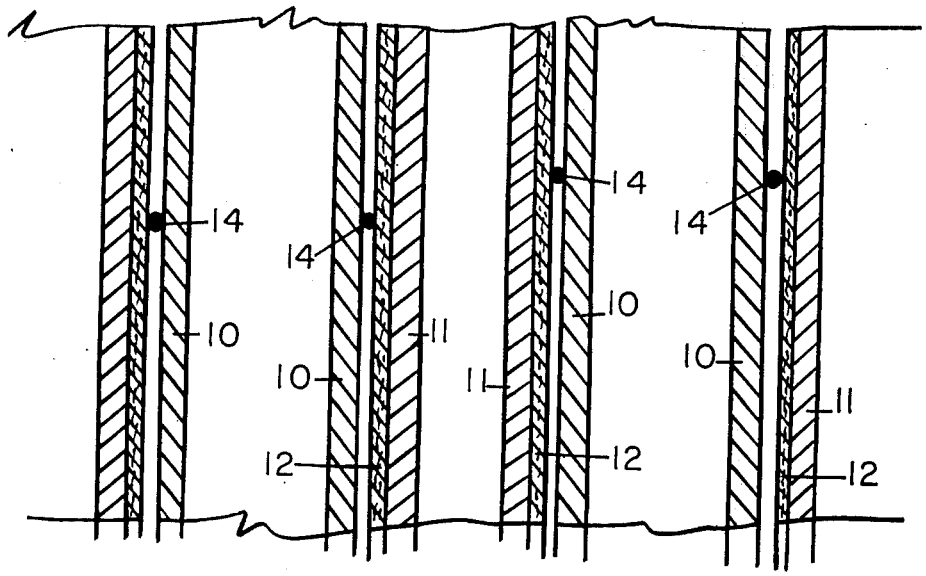
FIG. 3 is a top cross sectional showing positioning of the U shaped guides, taken at A—A of FIG. 2.

Narrow gaps for routine plant use, even in the larger cells, are possible and advantageous when the present invention is utilized. No unusual care in pre-straightening and pre-aligning of anode elements and of cathode elements is required to avoid scraping off of diaphragm material. Such extraordinary care, if required, would constitute a difficult and time consuming operation which would increase the cost of assembly. The anode or cathode elements, or both, of conventional construction and mounting have sufficient elasticity to be guided into position successfully by the guide spacers and hardened diaphragm combination, even when imperfectly aligned or imperfectly straightened to the degree normally encountered in practice. No such guides are disclosed in prior art cells which teach narrow inter-electrode gaps of less than 0.25 inch, such as described in U.S. Pat. No. 3,853,721 to Darlington et al, and U.S. Pat. No. 3,853,720 to Korach et al.

Other advantages result from the present invention with respect to prior art attempts to narrow the inter-electrode gap by means of expandable anodes, such as those taught in U.S. Pat. No. 3,674,676 to Fogelman and in U.S. Pat. No. 3,928,166 to O'Leary et al, or by adjustable anodes, such as those taught in U.S. Pat. No. 3,803,016 to Conner, Jr.

Voltage savings due to gap reduction are fully realized, since there is no need for spring elements in the anode structure. Such spring elements would necessarily lengthen the current path and correspondingly add to the voltage drop, thus partially defeating the purpose of their use.

No impairment of anolyte circulation efficiency by added obstructions inside the anode boxes occurs. This means that current efficiency is not impaired. Such impairment in prior art apparatus can result from dual posts or large spring elements, and may be especially deleterious in narrow gap cells because narrow gap cells have a greatly reduced passage for circulation between the anode and diaphragm. All narrow gap cells consequently are more dependent upon a supply of strong anolyte through the anode mesh, rather than from flow through the inter-electrode gap. Thus, any obstructions within the anode box, such as are required by prior art apparatus, are particularly objectionable in narrow gap cells.

Additionally, by avoiding use of dual posts or anode spring elements, the present invention saves in consumption of anode metal. This represents the simplest construction, and therefore the most reliable and maintenance-free, as well as the least expensive manner of solving the problem of reducing the inter-electrode gap.

Assembly and disassembly of the cells of the present invention are simple, in that no multiple width adjustments or fastenings are required, as is the case with adjustable anodes each time an adjustment is required.

The anodes of the present invention are less susceptible to deformation or other handling damage in routine plant use, in that the box-type anode construction of the present invention is considerably more rugged than prior art anodes of non-unitary construction, as typified by the adjustable anode and expandable anode apparatus of the prior art.

Increased reliability of performance results from the present invention because of the presence of fewer current-carrying welds, each of which represents a potential defect in commercial operation. Furthermore, no elongated slots are necessary in the anode base, simplifying the design of seals required to prevent anolyte leakage, and further increasing the reliability of performance.

EXAMPLE 1

A Hooker cell, type HC-3B, a 30,000 ampere chlor-alkali electrolytic test cell, was assembled with conventional dimensionally stable anodes and wide-fingered perforated plate cathodes to reduce the average anode to cathode gap from the normal gap of 11.0 millimeters to a gap of 7.8 millimeters. Guide spcers of the hairpin-type design, were constructed of rod stock of ⅛ inch (3.175 mm) diameter Trovidur, a proprietary chlorinated polyvinyl chloride, a tradename of Dynamit Nobel, a corporation of West Germany, and were placed over the anodes. The dimensionally stable asbestos-base polymer bonded diaphragm, containing 5% of a copolymer of ethylene and chlorotrifluoroethylene sold as MALAR, a trademark of Allied Chemical Corp., was deposited upon the cathode and the diaphragm was processed in the conventional manner. The test cell was assembled, operated for approximately six weeks, disassembled, re-diaphragmed and reinstalled to test the ease of disassembly and reinstallation. No unusual difficulty in assembly, disassembly, or reassembly was found. Voltage savings were observed in the test cell by comparison with the control cell described below in Example 3. Results of this comparison appear in the third column of Table 1.

EXAMPLE 2

A second HC-3B test cell comprising similar elements and assembled in the same manner as Example 1 was tested, except that the cathode element had been constructed to a width to leave an anode to cathode gap of 5.6 millimeters, compared with the normal gap of 11.0 millimeters, and guide spacers constructed of 1/16" (1.588 mm) diameter Trovidur rod were used. This cell was tested, and also disassembled, re-diaphragmed and reinstalled after approximately 6 weeks. No unusual difficulty in assembly, disassembly, or reassembly was found. Voltage savings were also observed and appear in the third column of Table 1.

EXAMPLE 3

A type HC-3B test cell with a standard anode to cathode gap of 11.0 millimeters was constructed and operated under conditions identical with those of Examples 1 and 2, and was used for the purpose of comparison. Results of the comparison of the reduced-gap test cells of Examples 1 and 2 with the control test cell of Example 3 are shown in Table 1, where voltage savings are listed.

The comparison of the cells in Table 1 shows a considerable savings in voltage for the narrowed gap cells, resulting in substantial savings in cost of power consumed for the electrolysis of brine in chlor-alkali cells.

These data did not change significantly after cell disassembly, re-diaphragming and reinstallation after approximately six weeks of operation.

EXAMPLE 4

Three Hooker cells, type H-4, 150,000 ampere chlor-alkali electrolytic test cells, were assembled from conventional anode bases, conventional cathodes, hard, dimensionally stable, asbestos-base diaphragms bonded with 5% HALAR, and hairpin-type guide spacers of ⅛" diameter Trovidur. Dimensionally stable ruthenium dioxide coated anodes having a width of 1.64 inches, instead of the conventional width of 1.39 inches. were installed. No unusual difficulty was encountered in assembly of any of these narrow gap cells. Three cells were tested, and average voltage savings under conditions of operation at 150,000 amperes were noted by comparison with the test cells of Example 7, such test cells representing an average of 71 operating cells with standard width anodes and standard asbestos diaphragms. Voltage savings are tabulated in column 7 of Table 2.

EXAMPLE 5

Another H-4 test cell similar to that of Example 4 was constructed, including wide anodes, but the coating upon the anodes consisted of platinum-iridium alloy instead of ruthenium dioxide. The results of the voltage savings of the one cell tested, by comparison with the control test cells of Example 7, are shown in Table 2 under operation at 150,000 amperes.

EXAMPLE 6

Two additional H-4 test cells were constructed in the manner of Example 4, except that the anodes were of conventional 1.39 inch width. These cells of conventional 11.0 millimeter gap did not require the use of guide spacers. Results of comparison with the control cells of Example 7 in operation at 150,000 amperes are shown in Column 7 in Table 2.

EXAMPLE 7

Standard H-4 control cells utilizing anodes of conventional 1.39 inch width, coated with ruthenium dioxide, and a diaphragm of asbestos only were tested at 150,000 amperes operation. Seventy-one cells were operated at 150,000 amperes, for comparison of the test cells of Examples 4, 5, and 6, results of which appear in column 7 in Table 2.

Table 2 shows that appreciable voltage savings occur, even with standard width electrodes with standard anode-to-diaphragm gaps, when bonded asbestos diaphragms are used. Further substantial savings are observed when the use of wide anodes is compared with the use of standard width anodes. Power savings represented by the voltage savings illustrated in Table 2 are substantial, and can lead to a substantial economic advantage to the use of wide anodes, bonded asbestos diaphragms, and guide spacers in combination.

Table I

Voltage Savings Due To Anode-Cathode Gap Reduction by Cathode Widening

| Cell Example | Anode-Cathode Gap | Comparison with Control of Example 3. Voltage Savings |
|---|---|---|
| 1 | 7.8 mm | 120 mv |
| 2 | 5.6 mm | 130 mv |
| 3 | 11.0 mm | — |

Table II

Voltage Savings Due To Anode-Cathode Gap Reduction by Anode Widening

| Cell Example | No. of Cells | Anode Width | Anode-Cathode Gap | Anode Coating | Diaphragm | Comparison With Control of Example 7 Voltage Savings |
|---|---|---|---|---|---|---|
| 4 | 3 | 1.64 in. | 7.8 mm | $RuO_2$ | 5% HALAR Bonded Asbestos | 250 mv |
| 5 | 1 | 1.64 in. | 7.8 mm | Pt-Ir | 5% HALAR Bonded Asbestos | 160 mv |
| 6 | 2 | 1.39 in. | 11.0 mm | $RuO_2$ | 5% HALAR Bonded Asbestos | 110 mv |
| 7(Control) | 71 | 1.39 in. | 11.0 mm | $RuO_2$ | Asbestos Only | — |

We claim:

1. A method for reducing the anode-cathode gap in an electrolytic diaphragm-type cell, said cell having a cell container, anode and cathode elements disposed within said container, said cathodes equipped with deposited polymer reinforced hard asbestos diaphragms, a cell base for mounting said anodes, and a cell top, each of said anode elements comprising a pair of substantially parallel non-adjustable blades in a spaced-apart relationship, which method comprises detachably mounting at least one non-perforated preformed substantially U-shaped guide spacer over the top of each anode, said guide spacer partially enclosing both blades of said anode element during assembly, each leg of said spacer being of a thickness smaller than the desired cathode-anode gap, assembling the cathodes and anodes by inserting one over the other so that each anode element is positioned between a pair of adjacent cathode elements with the guide spacers separating said elements to provide a cathode to anode gap of from about 5 millimeters to about 10 millimeters.

2. Method of claim 1 wherein the polymer used for reinforcing the diaphragm is selected from the group consisting of polytetrafluoroethylene, polyvinyl fluoride, polyvinylidene fluoride, poly(chlorotrifluoroethylene-ethylene), poly(tetrafluoroethylene-ethylene), polychlorotrifluoroethylene, and polyperfluoropropylene.

3. Method of claim 1 wherein said diaphragm comprises asbestos bonded with from about 1 to about 20% by weight polymer.

4. Method of claim 3 wherein said diaphragm comprises asbestos bonded with from about 2% to about 10% by weight of polymer.

5. The method of claim 1 wherein said guide spacers are constructed from a material selected from the group consisting of chlorinated polyvinyl chloride, polytetrafluoroethylene, polyvinyl fluoride, polyvinylidene fluoride, poly (chlorotrifluoroethylene-ethylene), polychlorotrifluoroethylene, and polyperfluoropropylene.

6. The method of claim 5 wherein said material is chlorinated polyvinyl chloride.

7. A method of claim 1 wherein the said cathode elements are foraminated plates.

8. A method of claim 1 wherein the said cathode elements are wire mesh.

9. A method of claim 1 wherein the said anode elements are dimensionally stable.

10. A method of assembling an apparatus for electrolysis of aqueous metal halide solutions, said apparatus having a cell container, anode and cathode-diaphragm elements disposed in said container, a cell base for mounting anodes and a cell top, each of said anode elements comprising a pair of substantially parallel non-adjustable blades in a spaced-apart relationship, said method comprising detachably mounting at least one non-perforated preformed substantially U-shaped guide spacer over the top of each anode, said guide spacer partially enclosing both blades of said anode element during assembly, each leg of said spacer being of a thickness smaller than the desired anode-cathode gap, employing a hard polymer reinforced asbestos diaphragm deposited on said cathode elements, assembling the cathodes and anodes by inserting one over the other so that each anode element is positioned between a pair of adjacent cathode elements with the guide spacer separating said elements to provide a cathode-anode gap of from about 5 millimeters to about 10 millimeters.

11. In an apparatus for electrolysis of aqueous alkali metal halide solutions, said apparatus comprising anode elements having a pair of substantially parallel non-adjustable blades in a spaced-apart relationship, cathode elements with mounted hard polymer reinforced diaphragms, a cell base for holding said anodes, a cell top and cell walls, the improvement comprising at least one detachable non-perforated preformed substantially U-shaped guide spacer placed over the top of each anode, said guide spacer partially enclosing both blades of said anode during assembly, each leg of said spacer being of a thickness less than the desired cathode-anode gap, functioning as a guide in assembly of said cell creating a cathode to anode gap of from about 5 millimeters to about 10 millimeters.

* * * * *